US006360463B1

(12) United States Patent
Huber et al.

(10) Patent No.: US 6,360,463 B1
(45) Date of Patent: Mar. 26, 2002

(54) CONVERSION DISPLAY DRIVE MECHANISM

(75) Inventors: Mortimer Huber, Stacy; Salvador Mendez, Roseville, both of MN (US)

(73) Assignee: Quality Manufacturing Incorporated, St. Paul, MN (US)

( * ) Notice: Subject to any disclaimer, the term of this patent is extended or adjusted under 35 U.S.C. 154(b) by 0 days.

(21) Appl. No.: 09/182,138

(22) Filed: Oct. 29, 1998

(51) Int. Cl.[7] ..... G09F 11/02
(52) U.S. Cl. ..... 40/505; 74/69
(58) Field of Search ..... 40/505; 74/69

(56) References Cited

U.S. PATENT DOCUMENTS

| | | | | |
|---|---|---|---|---|
| 1,721,597 A | | 7/1929 | Jones | |
| 3,202,262 A | | 8/1965 | Jones, Jr. | 198/24 |
| 3,234,674 A | * | 2/1966 | Simoneau | 40/505 |
| 3,295,381 A | | 1/1967 | Czarnecki | 74/84 |
| 3,304,638 A | | 2/1967 | Grandell et al. | 40/76 |
| 3,826,027 A | * | 7/1974 | Abbema | 40/505 X |
| 3,859,743 A | | 1/1975 | Schoenung | 40/33 |
| 3,918,183 A | | 11/1975 | Poulos | 40/33 |
| 4,015,349 A | * | 4/1977 | Dunne | 40/505 X |
| 4,048,868 A | | 9/1977 | Lock | 74/436 |
| 4,075,896 A | | 2/1978 | Pessina et al. | 74/69 |
| 4,189,859 A | * | 2/1980 | Ahlgren | 40/505 |
| 5,343,645 A | | 9/1994 | Huber | 40/505 |
| 5,692,330 A | * | 12/1997 | Anderson, Jr. | 40/505 |

* cited by examiner

*Primary Examiner*—B. Dayoan
*Assistant Examiner*—Andrea Chop
(74) *Attorney, Agent, or Firm*—Michael S. Sherrill

(57) ABSTRACT

A convertible sign mechanism is provided which comprises a convertible sign member that is rotatable about an axis. The convertible sign member is capable of rotating at a variable velocity. A motor is operatively connected to a drive shaft, which is connected to a cam follower. The cam follower is slidably connected to a member receiving the cam follower, with the receiving member being connected to an output gear. The output gear is connected to a drive gear, which together provide a reduction ratio of at least 2:1.

7 Claims, 3 Drawing Sheets

CONVERSION DISPLAY DRIVE MECHANISM

FIELD OF THE INVENTION

The present invention relates to a variable speed rotary drive mechanism. More specifically, the present invention includes a drive mechanism useful in operating display sign elements, such as those on prismatic displays, so as to vary the speed of rotation from a maximum velocity occurring during the changing of display surfaces to a minimum velocity occurring as the position corresponding to the display of the desired surface is approached.

BACKGROUND OF THE INVENTION

There are several known kinds of convertible signs, one type of which creates a display arrangement comprising single or multiple prisms, each of which are mounted at opposite longitudinal ends and rotatable about their longitudinal axis. in the case of multiple prisms, each prism is part of an equal sequence in a frame, the prisms residing beside each other. The sides of the prism are oriented in a permanently occurring sequence forming a number of displays corresponding to the number of side surfaces of the single prism. Such a sign necessarily includes a drive motor for synchronous rotation of the prisms via a transmission.

Displays of this type usually comprise triangular aluminum prisms, which rotate in an aluminum frame and show three displays in permanently recurring sequence. The prisms can be dismounted and exchanged. Due to the triangular shape of the prisms, three different views can be shown. The display arrangement can be mounted with its frame standing free, on walls or on roofs of buildings. Also, single prism signs are typically found on scoreboards in arenas or the like.

Known display arrangements of this type are typically driven by an electric motor, and the prisms are rotated synchronously by a gear transmission in such a manner that the sides of the respective prisms belonging to the same picture are shown simultaneously and form a display. The gear transmission ensures synchronous rotation of each prism.

A gear transmission, however, involves certain disadvantages. A desirable characteristic of most convertible signs is that they operate noiselessly, particularly when the displays are mounted on buildings. A gear transmission for operating noiselessly requires good lubrication. This requirement would be difficult to attend to at many sign locations, because of the need for periodic service and such signs in most cases are positioned in places of difficult access. The problem of access has created a need for mechanisms of high durability and reliability, along with the continuing requirement for accurate registration of the sign elements and the constant need to start, rotate and stop the sign display. Experience in the field has demonstrated the need to convert this inherently complex mechanical operation into one having as much reliability and simplicity as possible.

A recent solution to these problems is disclosed in commonly assigned U.S. Pat. No. 5,343,645, issued to Huber. There is disclosed a chain driven gear drive system, including off-center gear elements. These gear elements are rotated to translate various potential speeds to a mounting gear, on which a sign member is mounted. As a result of this structure, the sign member rotates through successive 120° turns while varying the speed of rotation from a maximum velocity occurring during the changing of display surfaces to a minimum velocity occurring as the position corresponding to the new display surface of the sign member, of the sign is approached.

What is needed is an alternate drive mechanism for driving display sign arrangements and other devices that require frequent start and stops.

SUMMARY OF THE INVENTION

The present invention provides an alternate variable speed rotary drive mechanism for operating display sign elements, such as those on prismatic displays, so as to vary the speed of rotation from a maximum velocity occurring during the changing of display surfaces to a minimum velocity occurring as the position corresponding to the display of the desired surface is approached. The variable speed rotary drive mechanism can also be used to drive other devices requiring frequent starts and stops, such as conveyors.

In one embodiment in accordance with the invention, a convertible sign mechanism is provided which comprises a convertible sign member that is rotatable about an axis. A drive means is connected to the convertible sign member for rotating the convertible sign member at a variable velocity, with the drive means operating continuously throughout the rotation of the convertible sign member. The drive means includes a motor, a drive shaft operatively connected to the motor, a cam follower operatively connected to the drive shaft, a member configured to receive the cam follower in a slidable engagement, an output gear operatively connected to the member; and a drive gear operatively connected to the output gear and to the convertible sign member. The output gear and the drive gear provide a reduction ratio of at least 2:1.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENT

Figure 1:
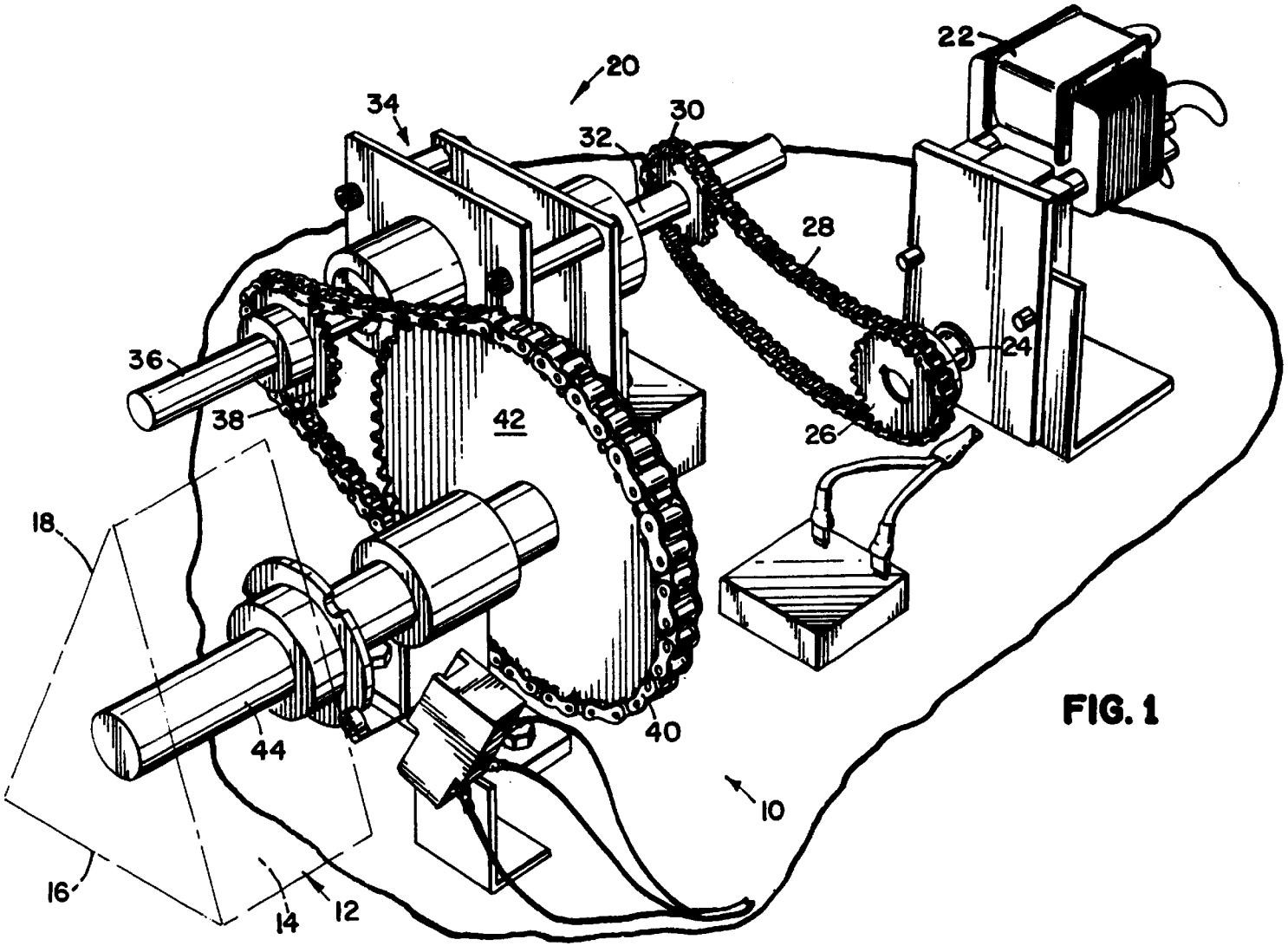
FIG. 1 is a perspective view of the convertible sign mechanism in accordance with the invention.

Referring to FIG. 1, a convertible sign mechanism according to the principles of the invention is shown generally at 10. The convertible sign mechanism 10 includes a multifaceted prismatic display member 12, which can have two or three sides, but in the specific example is shown to have three-sides 14, 16, 18. The sides 14, 16, 18 typically contain different information, and when in a multiple prismatic sign, are typically ganged or combined together with similar display members in a coordinated manner to form the desired sign. The mechanism 10 further includes a drive mechanism 20 for rotating the display member 12 about its central axis so that each side 14, 16, 18 is periodically brought into view.

Figure 2:
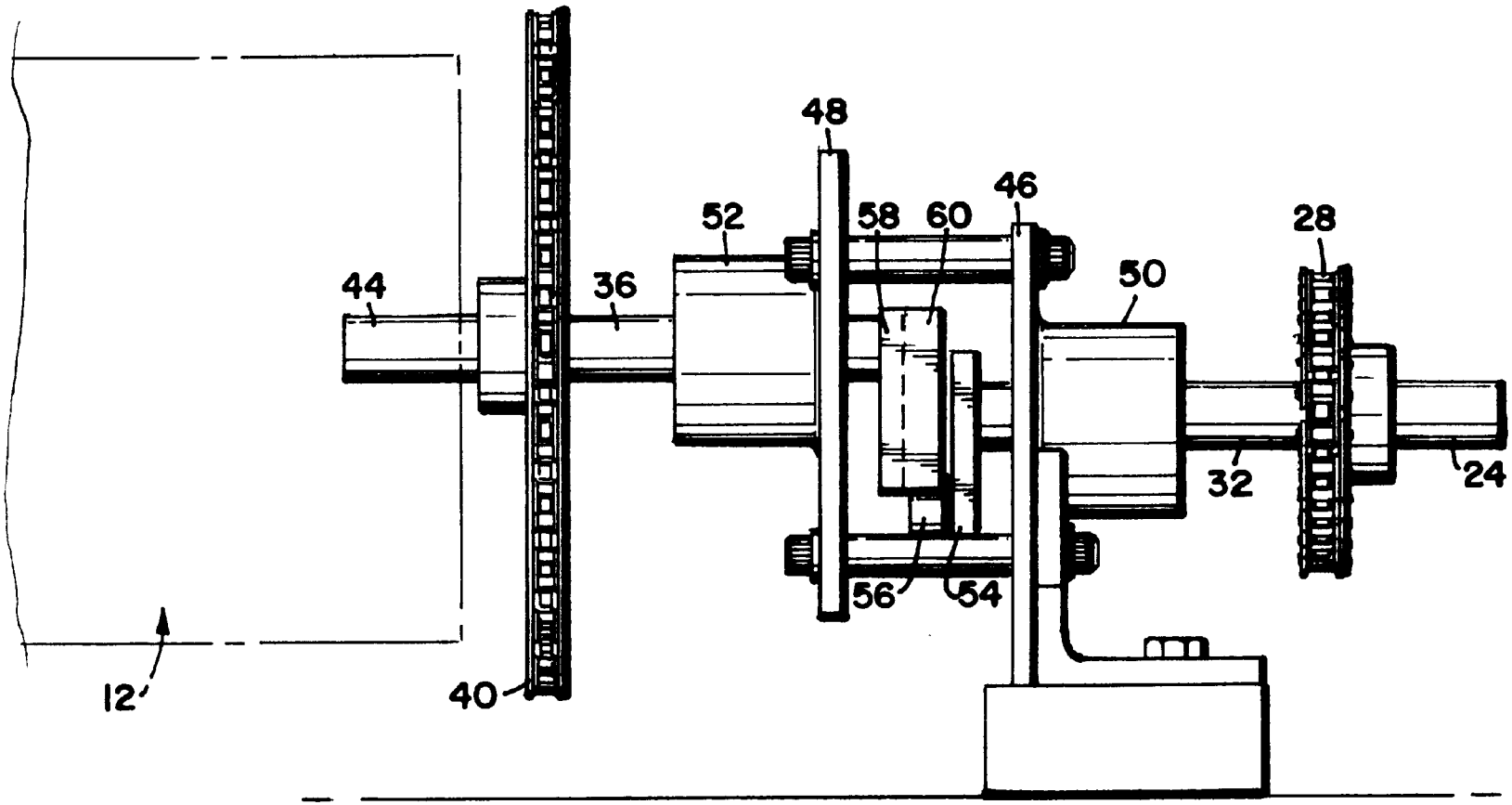
FIG. 2 is a side view of the of the mechanism, with the motion transmission device in a first position.

With reference now to FIGS. 1 and 2, the drive mechanism 20 generally includes a suitable electric motor 22 having a drive shaft 24 with a pinion gear 26 fixed thereto, such that the pinion gear 26 is rotatably driven by the motor 22. The motor 22 is typically timed by conventional timing devices or the motor can be under computer control. An endless chain 28 is disposed over the drive gear 26 and an input gear 30 that is fixed to an input shaft 32 which forms the input to a variable speed, motion transmitting device 34. An output shaft 36 extends from the device 34 and has an output gear 38 fixed thereon so as to rotate with the output shaft 36. A second endless chain 40 is disposed over the output gear 38 and a large diameter drive gear 42 that is fixed to a shaft 44 which is connected to the display member 12.

When the motor 22 is activated, the drive shaft 24 rotates the pinion gear 24 which drives the endless chain 28. The endless chain 28 in turn drives the input gear 30, thereby rotating the input shaft 32. The motion transmitting device 34 continuously varies the rotational speed input by the input shaft 32, so that the rotational speed of the output shaft 36 and the output gear 38 are continuously varied. The rotation of the output gear 38 is transmitted by the endless chain 40 to the large diameter drive gear 42 which drives the shaft 44 thereby causing the display member 12 to rotate so as to change the side 14, 16, 18 that is viewed.

A concern when driving members that are periodically stopped and started, such as prismatic display members and conveyor systems which stop and start at fill stations, is that the initial start of movement from a fully stopped condition be gradual. The movement speed should eventually build up to a maximum, and then gradually decrease as the driven member starts approaching its next intended position. Applicant's have found that this gradual increase and gradual decrease of movement speed avoids the shock of abrupt starts and stops, and minimizes wear on components.

In order to accomplish the gradual increase and gradual decrease of the rotational speed of the display member 12, the motion transmitting device 34 is specifically designed to convert the constant speed rotational input provided by the input shaft 32 into a smooth, cyclically varying speed, accelerating-decelerating rotational output to the output shaft 36.

With reference specifically to FIG. 2, it is seen that the motion transmitting device 34 includes a pair of spaced side walls 46, 48, each of which includes a bearing 50, 52 associated therewith for rotatably supporting the respective shafts 32, 36. A cam follower arm 54 is suitably fixed to the end of the input shaft 32, such as by a key, so as to rotate with the input shaft 32. A follower 56, such as a rotating bearing or a sliding bearing, is fixed to the follower arm 54 and is spaced radially of the axis of the input shaft 32. A cam arm 58 is suitably fixed at one end thereof to the end of the output shaft 36, such as by a key, whereby the cam arm 58 is eccentrically mounted. The cam arm 58 includes a slot 60 formed therein which extends longitudinally the length of the cam arm 58, and the follower 56 is slideably received within the slot 60. Thus, as the input shaft 32 rotates, the output shaft 36 rotates as a cyclically varying speed due to the cam and follower arrangement.

Preferably, the follower 56 is spaced from the axis of the input shaft 32 a distance slightly greater than the distance between the axes of the input and output shafts. Thus, as the input shaft 32 rotates, the cam follower arm 54 and the follower 56 rotate therewith. Rotation of the follower arm 54 and follower 56 causes the cam arm 58 and the output shaft 36 to rotate. The rotational speed of the input shaft 32 can be assumed to be constant, and therefore due to the arrangement of the device 34, the rotational speed of the output shaft 36 will vary from a maximum when the follower arm/follower 54, 56 and the cam arm 58 are in the position shown in FIGS. 2 and 3, to a minimum when the follower arm/follower and cam arm are displaced 180° to the position shown in FIG. 5. The transition between maximum and minimum rotational speeds of the output shaft 36 occurs in an extremely smooth manner due to this arrangement, such that abrupt starts and stops are avoided.

Figure 3:
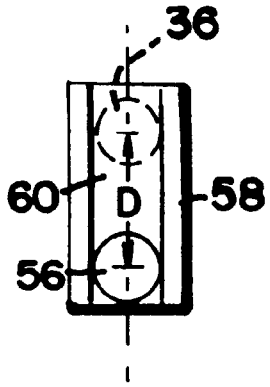
FIG. 3 is a schematic view of the motion transmitting device in a first position.

The variation in rotational speed occurs based upon the distance of the follower 56 from the axis of the output shaft 36. Referring now to FIGS. 3–6, when the follower 56 is at its maximum distance from the output shaft axis, as illustrated in FIG. 3, the torque acting on the cam arm 58 is greatest since the moment arm D of the force acting on the cam arm is at its maximum. As the elements rotate to the position shown in FIG. 4, the follower 56 is moving toward the output shaft 36, and thus the rotational speed of the output shaft 36 is continuously decreasing. When the elements reach the position shown in FIG. 5, the follower 56 has moved to its closest distance to the output shaft axis. Therefore, the torque acting on the cam arm 58 is at its minimum, since the moment arm of the force is at its minimum. As the elements rotate from the position shown in FIG. 5 to the position shown in FIG. 6, the follower 56 moves away from the output shaft 36 so that the rotational speed thereof gradually increases.

It is important that the follower 56 be spaced from the axis of the input shaft 32 a distance slightly greater than the distance between the axes of the input and output shafts, i.e. the axis of the follower 56, should not coincide with the axis of the output shaft 36. This prevents binding of the follower 56 in the cam arm 58, which would stop rotation of the output shaft 36 and possibly damage the components.

Figure 5:
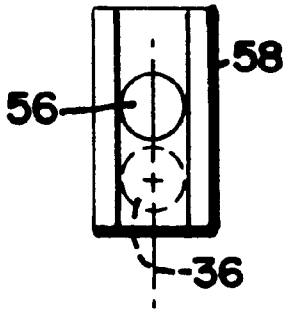
FIG. 5 is a schematic view of the motion transmitting device in a third position.
Figure 6:
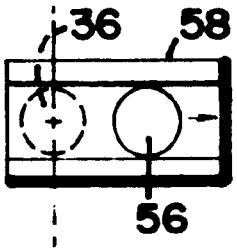
FIG. 6 is a schematic view of the motion transmitting device in a fourth position.

Assuming that the display member 12 is initially at rest and the side 14 is currently viewable, then to view the side 16 the display member 12 must be rotated about its axis. This is accomplished by activating the motor 22, which drives the input shaft 32 in the suitable direction. Initially, the follower 56 and cam arm 58 are in their minimum rotational speed position (FIG. 5). When the input shaft 32 is rotated, the follower arm 54/follower 56 start driving the cam arm 58, with the rotational speed gradually increasing as the follower 56 and cam arm 58 move away from the minimum speed position (FIG. 6). Concurrently, the display member 12 starts to gradually rotate from its stopped position.

Figure 4:
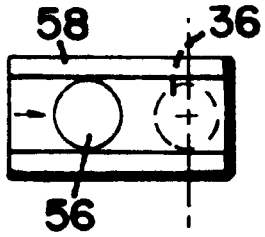
FIG. 4 is a schematic view of the motion transmitting device in a second position.

Continued rotation causes the follower 56 and cam arm 58 to reach their maximum speed position (FIG. 3), at which point the display member 12 is being driven at its maximum speed and the side 16 is partially visible. As the follower 56 and cam arm 58 move from the maximum speed position, the speed of the display member 12 starts decreasing as the side 16 of the display member is starting to approach its fully viewed position (FIG. 4). When the side 16 reaches its fully viewed position, the follower 56 and cam arm 58 will be back at their minimum speed position (FIG. 6). To stop the display member 12 in position, one need only to deactivate the motor 22 at the minimum speed position.

Ideally, for a three-sided (prismatic) display member 12, the output gear 38 and the large diameter drive gear 42 are sized to provide a 3:1 reduction ratio, such that a complete cyclic speed variation provided by the motion transmitting device 34 occurs for every 120° rotation of the display member 12. This ensures that the display member 12 goes through the cycle of gradual speed increase, maximum speed, and gradual speed decrease to minimum speed each time a new side is to be viewed. For a two sided display member a 2:1 reduction ratio would be provided.

While the invention has been described herein as driving a display member, the invention could also be used to drive any member requiring frequent starts and stops, such as conveyors with containers thereon which stop and start at fill stations to fill the containers. The gradual increase and decrease of speed provided by the motion transmitting device described herein would prevent the containers on the conveyor from tipping over, with the maximum speed between starting and stopping maintaining efficient operation of the conveyor.

The above specification provides a complete description of the manufacture and use of the invention. Since many embodiments of the invention can be made without departing from the spirit and scope of the invention, the invention resides in the claims hereinafter appended.

What is claimed is:

1. A convertible sign mechanism comprising:

a convertible sign member being rotatable about an axis;

drive means connected to said convertible sign member for rotating said convertible sign member at a variable velocity, said drive means operating continuously throughout the rotation of said convertible sign member, said drive means including:

a motor;

a drive shaft operatively connected to said motor;

a cam follower operatively connected to said drive shaft;

a member configured to receive said cam follower in a slidable engagement;

an output gear operatively connected to said member; and a drive gear operatively connected with said output gear and said convertible sign member;

said output gear and said drive gear providing a reduction ratio of at least 2:1.

2. The convertible sign mechanism of claim 1, wherein said reduction ratio is 3:1.

3. The convertible sign mechanism of claim 2, further comprising a prismatic display arrangement.

4. The convertible sign mechanism of claim 1, member configured to receive said cam follower includes a slotted cam arm.

5. A convertible sign mechanism having drive means for rotating a structure in a continuous manner at a variable velocity, said drive means comprising:

a motor;

a drive shaft operatively connected to said motor;

a cam follower operatively connected to said drive shaft;

a member configured to receive said cam follower in a slidable engagement;

an output gear operatively connected to said member;

a drive gear operatively connected to said output gear and effective for being operatively connected to a structure to be rotated: and said output gear and said drive gear providing a reduction ratio of at least 2:1.

6. The convertible sign mechanism of claim 5, wherein said reduction ratio is 3:1.

7. The convertible sign mechanism of claim 5, wherein said member configured to receive said cam follower includes a slotted cam arm.

* * * * *

UNITED STATES PATENT AND TRADEMARK OFFICE

CERTIFICATE OF CORRECTION

PATENT NO. : 6,360,463 B1
DATED : March 26, 2002
INVENTOR(S) : Huber et al.

It is certified that error appears in the above-identified patent and that said Letters Patent is hereby corrected as shown below:

Column 6,
Line 11, "claim, 1 member" should be -- claim 1, wherein said member --

Signed and Sealed this

Fourth Day of February, 2003

JAMES E. ROGAN
*Director of the United States Patent and Trademark Office*